US006415516B1

(12) United States Patent
Tirado et al.

(10) Patent No.: US 6,415,516 B1
(45) Date of Patent: Jul. 9, 2002

(54) POWER CUTTING DEVICE

(76) Inventors: Javier B. Tirado; Alicia Prado, both of 217 Landis Ave. #B, Chula Vista, CA (US) 91910

( * ) Notice: Subject to any disclaimer, the term of this patent is extended or adjusted under 35 U.S.C. 154(b) by 0 days.

(21) Appl. No.: 09/714,912

(22) Filed: Nov. 17, 2000

(51) Int. Cl.[7] ..... B26B 17/14
(52) U.S. Cl. ..... 30/386; 30/381; 30/383
(58) Field of Search ..... 30/381, 382, 383, 30/384, 386, 272.1, 277.4

(56) References Cited

U.S. PATENT DOCUMENTS

| | | | | | |
|---|---|---|---|---|---|
| 2,596,081 | A | | 5/1952 | Sacrey | |
| 2,711,761 | A | | 6/1955 | Grants | |
| 3,298,406 | A | * | 1/1967 | Erickson | 30/384 |
| 3,343,613 | A | * | 9/1967 | Carnesecca, Jr. et al. | 30/381 |
| 3,829,970 | A | | 8/1974 | Anderson | |
| 3,857,179 | A | * | 12/1974 | Haupt et al. | 30/381 |
| 4,001,937 | A | | 1/1977 | Stelljes et al. | |
| 5,528,835 | A | * | 6/1996 | Ra | 30/386 |
| 5,685,080 | A | * | 11/1997 | Amano et al. | 30/383 |
| 5,725,530 | A | * | 3/1998 | Popken | 30/381 |
| 5,791,057 | A | | 8/1998 | Nakamura et al. | |
| D408,699 | S | | 4/1999 | Zurwelle | |

* cited by examiner

*Primary Examiner*—Hwei-Slu Payer

(57) ABSTRACT

A power cutting device for cutting material in tight places. The power cutting device includes a power cutting device comprising a housing. The housing includes a first end and a second end. A first shaft is securely coupled in and extending away from the housing. A handle member is integrally coupled to a second end of the housing. A motor is positioned generally in the housing. A power supply for powering the motor is operationally coupled to the motor. A first actuating element for starting the motor is positioned in the handle member and operationally coupled to the motor. A first gear is mechanically coupled to the motor. A blade supporting member for supporting a cutting a member is positioned generally in the housing and removably coupled to the first shaft. A cutting member for cutting a variety of materials is movably coupled to the blade supporting member and the first gear.

12 Claims, 5 Drawing Sheets

POWER CUTTING DEVICE

BACKGROUND OF THE INVENTION

1. Field of the Invention

The present invention relates to power cutting tools and more particularly pertains to a new power cutting device for cutting material in tight places.

2. Description of the Prior Art.

The use of power cutting tools is known in the prior art. More specifically, power cutting tools heretofore devised and utilized are known to consist basically of familiar, expected and obvious structural configurations, notwithstanding the myriad of, designs encompassed by the crowded prior art which have been developed for the fulfillment of countless objectives and requirements.

Known prior art includes U.S. Pat. No. 2,596,081; U.S. Pat. No. 4,001,937; U.S. Pat. No. 2,7.11,761; U.S. Pat. No. 3,829,970; U.S. Pat. No. 5,791,057; and U.S. Pat. No. Des. 408,699.

While these devices fulfill their respective, particular objectives and requirements, the aforementioned patents do not disclose a new power cutting device. The inventive device includes a power cutting device comprising a housing. The housing includes a first end and a second end. A first shaft is securely coupled in and extending away from the housing. A handle member is integrally coupled to a second end of the housing. A motor is positioned generally in the housing. A power supply for powering the motor is operationally coupled to the motor. A first actuating means for starting the motor is positioned in the handle member and operationally coupled to the motor. A first gear is mechanically coupled to the motor. A blade supporting member for supporting a cutting means is positioned generally in the housing and removably coupled to the first shaft. A cutting means for cutting a variety of materials is movably coupled to the blade supporting member and the first gear.

In these respects, the power cutting device according to the present invention substantially departs from the conventional concepts and designs of the prior art, and in so doing provides an apparatus primarily developed for the purpose of cutting material in tight places.

SUMMARY OF THE INVENTION

In view of the foregoing disadvantages inherent in the known types of power cutting tools now present in the prior art, the present invention provides a new power cutting device construction wherein the same can be utilized for cutting material in tight places.

The general purpose of the present invention, which will be described subsequently in greater detail, is to provide a new power cutting device apparatus and method which has many of the advantages of the power cutting tools mentioned heretofore and many novel features that result in a new power cutting device which is not anticipated, rendered obvious, suggested, or even implied by any of the prior art power cutting tools, either alone or in any combination thereof.

To attain this, the present invention generally comprises a power cutting device comprising a housing. The housing includes a first end and a second end. A first shaft is securely coupled in and extending away from the housing. A handle member is integrally coupled to a second end of the housing. A motor is positioned generally in the housing. A power supply for powering the motor is operationally coupled to the motor. A first actuating means for starting the motor is positioned in the handle member and operationally coupled to the motor. A first gear is mechanically coupled to the motor. A blade supporting member for supporting a cutting means is positioned generally in the housing and removably coupled to the first shaft. A cutting means for cutting a variety of materials is movably coupled to the blade supporting member and the first gear.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. Thee invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new power cutting device apparatus and method which has many of the advantages of the power cutting tools mentioned heretofore and many novel features that result in a new power cutting device which is not anticipated, rendered obvious, suggested, or even implied by any of the prior art power cutting tools, either alone or in any combination thereof.

It is another object of the present invention to provide a new power cutting device which may be easily and efficiently manufactured and marketed.

It is a further object of the present invention to provide a new power cutting device which is of a durable and reliable construction.

An even further object of the present invention is to provide a new power cutting device which is susceptible of a low cost of manufacture with regard to both materials and labor, and which accordingly is then susceptible of low prices of sale to the consuming public, thereby making such power cutting device economically available to the buying public.

Still yet another object of the present invention is to provide a new power cutting device which provides in the apparatuses and methods of the prior art some of the advantages thereof, while simultaneously overcoming some of the disadvantages normally associated therewith.

Still another object of the present invention is to provide a new power cutting device for cutting material in tight places.

Yet another object of the present invention is to provide a new power cutting device which includes a power cutting device comprising a housing. The housing includes a first end and a second end. A first shaft is securely coupled in and extending away from the housing. A handle member is integrally coupled to a second end of the housing. A motor is positioned generally in the housing. A power supply for powering the motor is operationally coupled to the motor. A first actuating means for starting the motor is positioned in the handle member and operationally coupled to the motor. A first gear is mechanically coupled to the motor. A blade supporting member for supporting a cutting means is positioned generally in the housing and removably coupled to the first shaft. A cutting means for cutting a variety of materials is movably coupled to the blade supporting member and the first gear.

Still yet another object of the present invention is to provide a new power cutting device that utilizes a chain type saw for cutting materials in traditionally tight spaces.

Even still another object of the present invention is to provide a new power cutting device that can be easily carried and used by both professionals and homeowners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
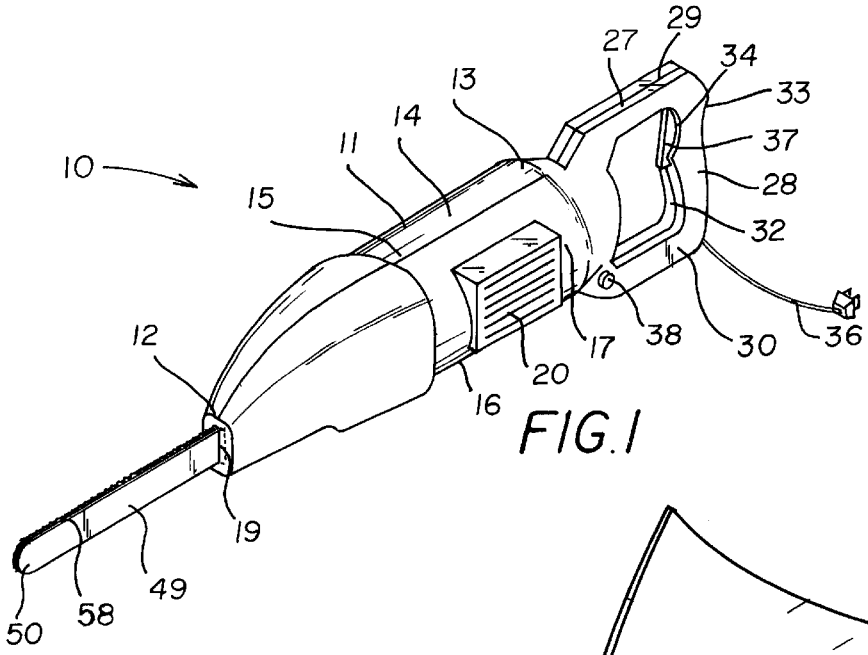
FIG. 1 is a schematic perspective view of a new power cutting device according to the present invention.
Figure 4:
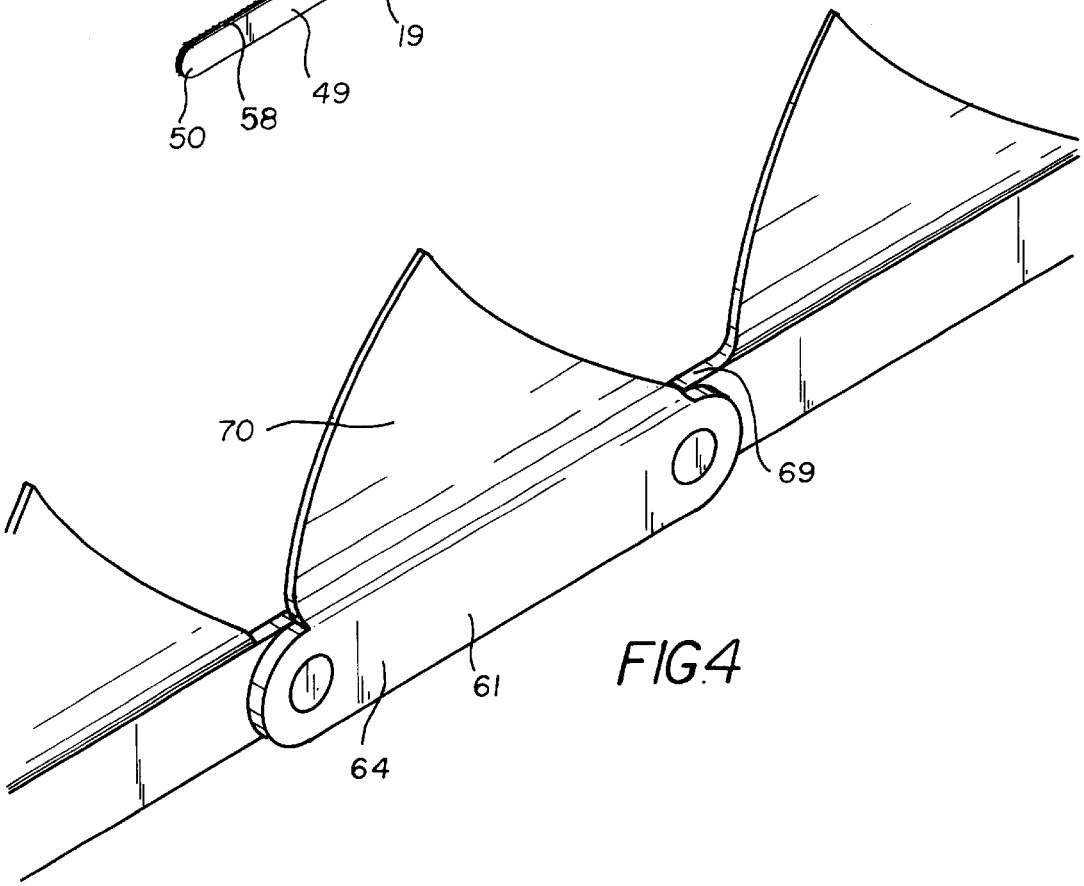
FIG. 4 is a schematic perspective view of the present invention showing the cutting means.
Figure 2:
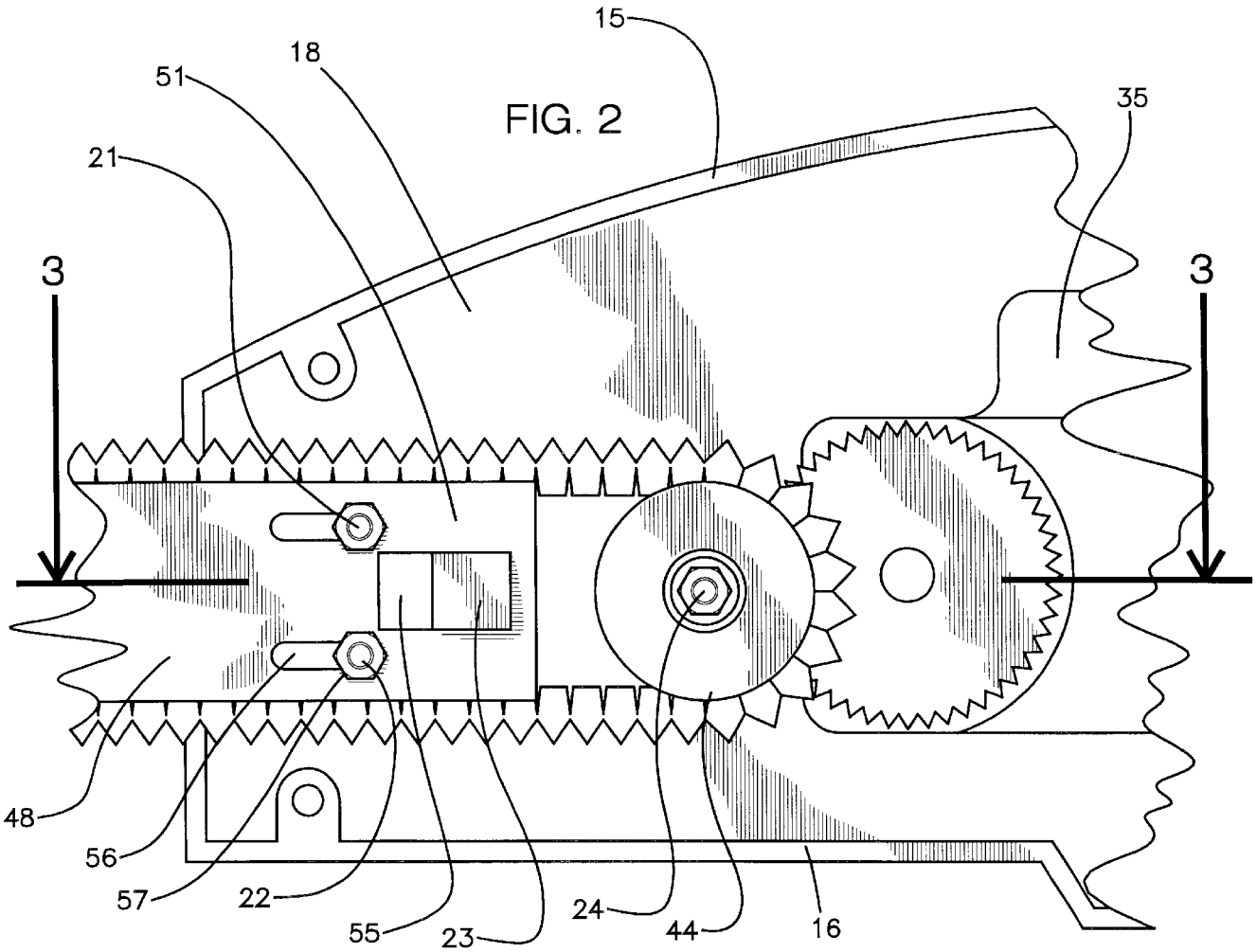
FIG. 2 is a schematic cross-sectional view of the present invention.
Figure 3:
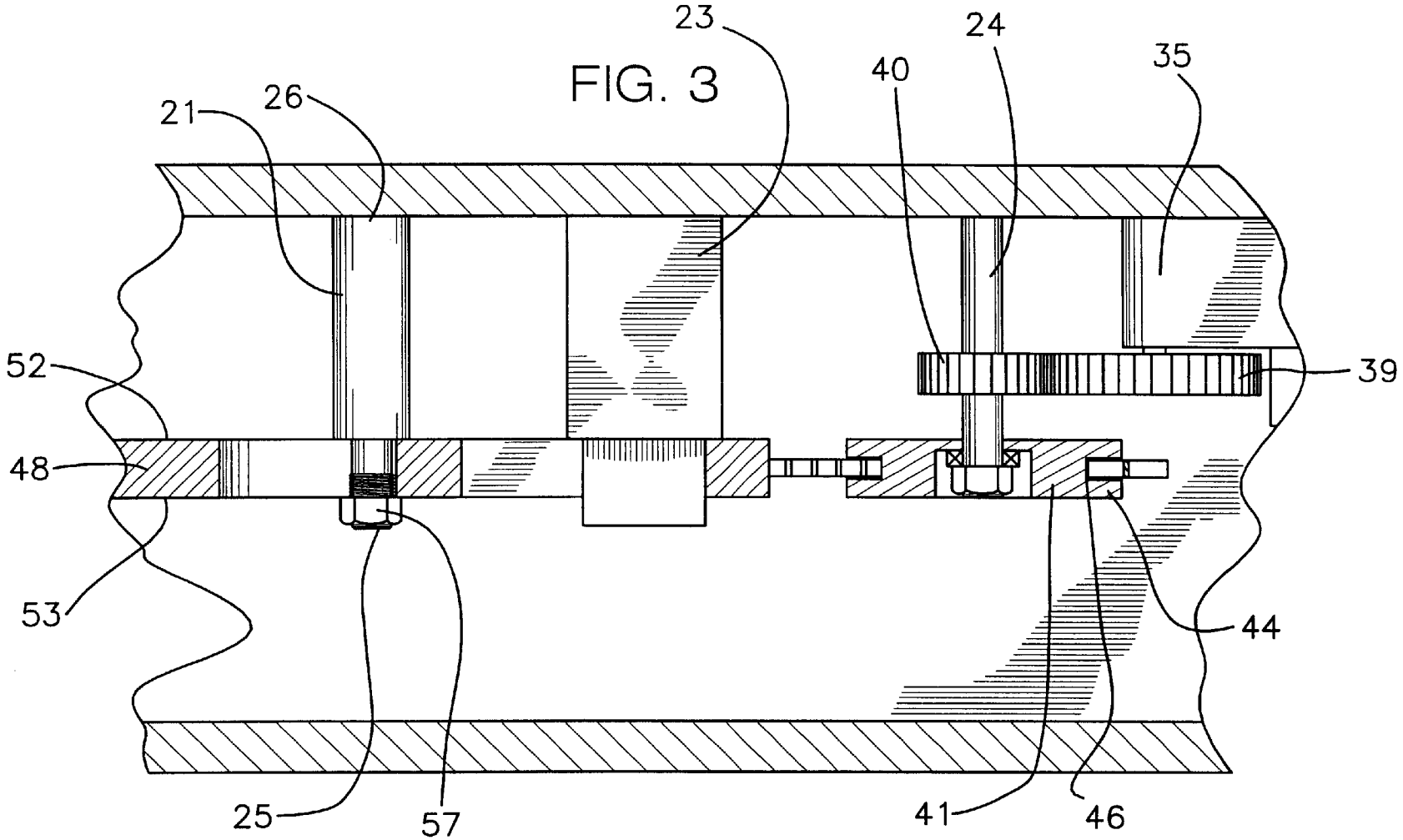
FIG. 3 is a schematic top view of the present invention showing the shafts and the gears taken along line 3—3 of FIG. 2.
Figure 5:
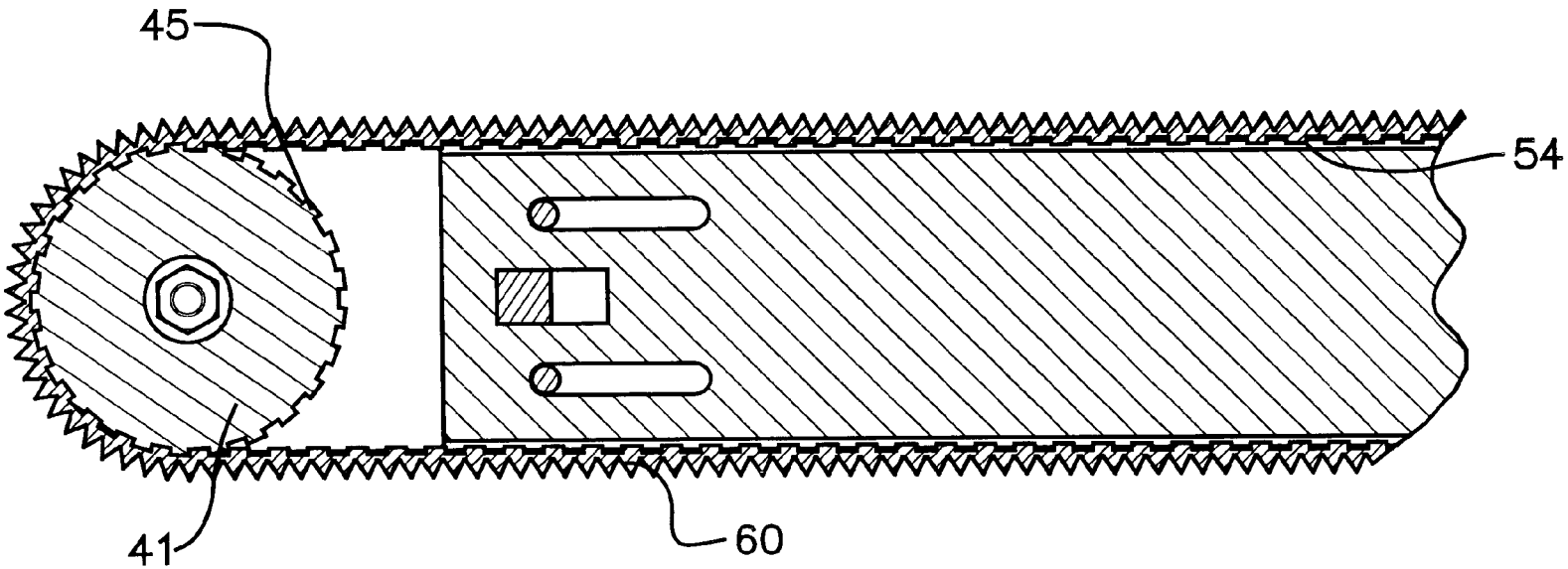
FIG. 5 is a schematic side view of the present invention showing the blade supporting member and the first gear.
Figure 6:
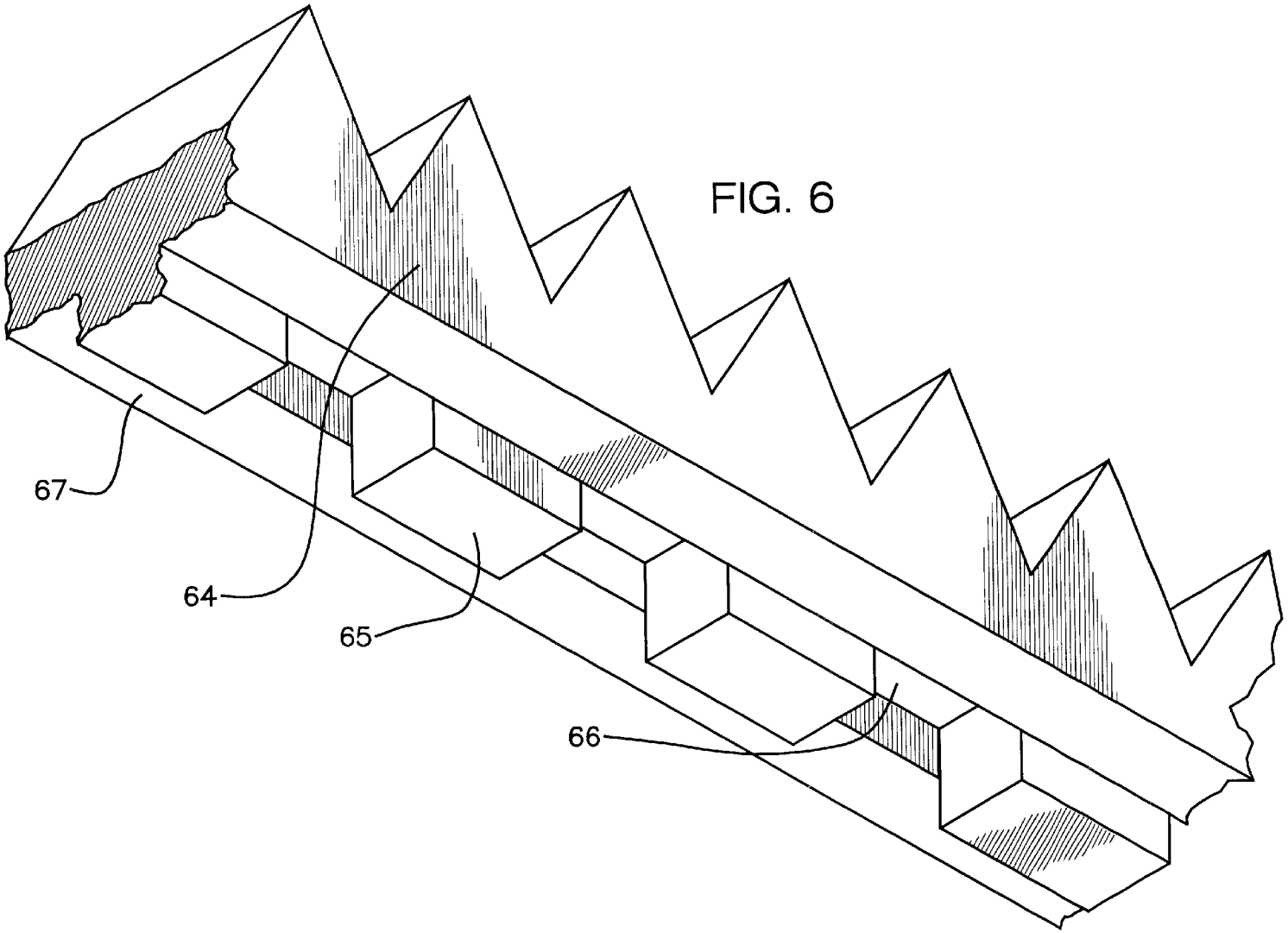
FIG. 6 is a schematic bottom view of the present invention showing the bottom of the cutting means.

With reference now to the drawings, and in particular to FIGS. 1 through 6 thereof, a new power cutting device embodying the principles and concepts of the present invention and generally designated by the reference numeral 10 will be described.

As best illustrated in FIGS. 1 through 6, the power cutting device 10 generally comprises a housing 11. The housing 11 includes a first end 12, a second end 13 and a peripheral wall 14 extending there between. The peripheral wall 14 includes a top side 15, a bottom side 16, a first lateral side 17, a second lateral side 18. The first end 12 includes an opening 19 therein. The peripheral wall includes a plurality of apertures 20 therein. Each of the apertures 20 is positioned in the first lateral side 17 and positioned generally adjacent to the second end 13 of the housing 11. The apertures 20 act as a ventilation to the inside of the housing 11. There is a top wall and a pair of side walls that are integrally coupled to the peripheral wall 14 of the housing 11 that causes the apertures 20 to extend away from the peripheral wall 14. The peripheral wall 14 tapers to the first end 12.

In the housing 11 there is a first shaft 21, a second shaft 22, a third shaft 23 and a fourth shaft 24. Each of the shafts include a first end 25 and a second end 26. The first end 25 of each of the shafts 21, 22, 23, and 24 is securably coupled to an inner surface of the peripheral wall 14 in the housing 11. Each of the shafts 21, 22, 23, 24 is orientated generally perpendicular to a longitudinal axis of a line extending through the first and the second ends 12 and 13 of the housing 11 and parallel to a plane of the bottom side 16 of the housing 11.

The first shaft 21 is positioned adjacent to the first end 12 and generally nearer the top side 15 of the housing 11 than the bottom side 16 of the housing 11. The second shaft 22 is positioned generally adjacent to the first end 12 of the housing 11 and positioned generally nearer the bottom side 16 of the housing 11 than the top side 15 of the housing 11. The third shaft 23 is positioned generally adjacent to the first and second shafts 21 and 22. The fourth shaft 24 is positioned generally adjacent to the third shaft 23.

A handle member 27 comprising a base 28 that includes a first leg 29 and a second leg 30 integrally coupled to the base 28 and extending away from the base 28 and is integrally coupled to the second end 13 of the housing 11. The base 28 includes an inner surface 32 and an outer surface 33. The inner surface 32 of the base 28 includes a notch 34 therein. The notch 34 is positioned generally adjacent to the first leg 29.

A motor 35 is positioned generally in the housing 11 and positioned generally adjacent to the second end 13 of the housing 11. The motor 35 is securably coupled to the inner surface of the peripheral wall 14 of housing 11. The motor 35 comprises an electric motor. However, other types of motors may be used such as a gas motor.

A power supply 36 for powering the motor 35 is operationally coupled to the motor 35. The power supply 36 comprises a cord. However, the power supply could also comprise a battery or a rechargeable battery.

A first actuating means 37 for starting the motor 35 is positioned in the notch 34 of the inner surface 32 of the handle member 27. The first actuating means 37 is operationally coupled to the motor 35. The first actuating means 37 comprises a switch. The switch generally takes the form of a trigger switch, however, other forms of actuating means may be used such as a knob.

A second actuating means 38 for selectively varying the speed of the motor 35 extends outwardly through the handle member 27. The second actuating means 38 is operationally coupled to the motor 35. The second actuating means 38 may take the form of a conventional knob.

In the housing 11 there are a plurality of gears. Each of the gears includes a peripheral edge 44 that include plurality of teeth 45 coupled thereto and extending away therefrom. The plurality of gears including a first gear 39. The first gear 39 is mechanically coupled to the motor 35. In an embodiment the motor 35 is designed to rotate the first gear 39.

The fourth shaft 24 extends through the second gear 40. The second gear 40 is positioned such that the teeth 45 of the second gear 40 may engage the teeth 45 of the first gear 39. In an embodiment the first gear rotates the second gear.

A third gear 41 is securably coupled to the second end of the fourth shaft 24. The third gear 41 includes a peripheral edge 44 that includes a groove 46 therein. A plurality of teeth 45 extend outwardly from the groove 46.

There is also a blade supporting member 48 for supporting a cutting means 60. The blade supporting member 48 comprises an elongated member 49 that includes a first end 50, a second end 51, a first side 52, a second side 53 and a peripheral edge 54. The first end 50 of the blade supporting member 48 is generally rounded for easier movement of the cutting means 60. The second end 51 of the blade supporting member 48 is positioned generally in the housing 11 such that the blade supporting member 48 extends through the opening 19 in the first end 12 of the housing 11. The blade supporting member 48 includes an elongated hole 55 and a pair of elongated slots 56 therein. Each of the slots 56 is positioned generally adjacent to the second end 51 of the blade supporting member 48. The first and second shafts 21 and 22 of the housing 11 each include a size and shape designed for removably positioning in one of the elongated slots 56. There are a pair of fastening means 57 for securing the blade supporting member 48 to the first and the second shaft, 21 and 22. Each of the fastening means 57 is securably coupled to a free end of the first and second shafts 21 and 22. The elongated hole 55 is positioned generally between the pair of elongated slots 56 and generally nearer the second end 51 than each of the elongated slots 56. The third shaft 23 of the housing 11 includes a size and shape designed for extending into the elongated hole 55. The elongated hole 55 and the elongated slot 56 allow the blade supporting member to be moved, the peripheral edge of the blade supporting member 48 to move in and out of the housing 11. The blade supporting member 48 has a groove in its peripheral edge 54 In an embodiment the peripheral edge 54 of the elongated supporting member 48 and the groove 46 of the third gear 41 define a cutting means path.

The power cutting device also includes a cutting means 60 for cutting a variety of materials. The cutting means 60 comprises a plurality of links 61. Each of the links 61 is pivotally coupled to each other such that a loop of the links 61 is defined. Each of the links 61 includes a bottom portion 64 and a top portion 69. Each of the top portions 69 comprises a blade member 70 extending away from the bottom portion 64. Each of the bottom portions 64 comprises a block member 65. Each of the block members 65 is movably positiotiable in the cutting path. A bottom surface 67 of each of the bottom portions 64 includes a niche 66 therein for selectively receiving one of the teeth 45 in the third gear 41.

In an embodiment the motor 35 rotates the first gear 39 such that the second gear 40 rotates the third gear 41. In an embodiment the cutting means 60 is moved about the cutting means path.

In use, a user pulls the first actuating means 37 to start the motor 35. The user then turns the second actuating means 38 to set the speed of the motor 35. The user then presses the blade supporting member 48 against the material to be cut that is then cut by the cutting means 60 rotating in the cutting path.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A power cutting device comprising:

a housing having a first end and a second end;

a first shaft, said shaft being securely coupled in and extending away from said housing;

a handle member being integrally coupled to said second end of said housing;

a motor, said motor being positioned generally in said housing;

a power supply for powering said motor, said power supply being operationally coupled to said motor;

a first actuating means for starting said motor, said first actuating means being positioned in said handle member and operationally coupled to said motor;

a first gear, said first gear being mechanically coupled to said motor;

a blade supporting member for supporting a cutting means, said blade supporting member being positioned generally in said housing and removably coupled to said first shaft; and a cutting means for cutting a variety of materials, said cutting means being movably coupled to said blade supporting member and said first gear;

said housing having a peripheral wall extending between said first and second ends, said peripheral wall of said housing having a top side, a bottom side, a first lateral side, a second lateral side, said first end having an opening therein;

a second shaft, a third shaft and a fourth shaft, each of said shafts having a first end and a second end, said first end of each of said shafts being securably coupled to an inner surface of said peripheral wall in said housing;

a second gear and a third gear, each of said gears having a peripheral edge having plurality of teeth coupled thereto and extending away therefrom, said fourth shaft extending through said second gear, said second gear being positioned such that said teeth of said second gear may engage said teeth of said first gear, wherein said first gear rotates said second gear, said third gear being securably coupled to said second end of said fourth shaft, said third gear having a peripheral edge having a groove therein, a plurality of teeth extending outwardly from said groove;

said blade supporting member comprising an elongated member having a first end, a second end, a first side, a second side and a peripheral edge, said first end of said blade supporting member being generally rounded, said second end of said blade supporting member being positioned generally in said housing such that said blade supporting member extends through said opening in said first end of said housing, said peripheral edge of said blade supporting member having a groove therein, wherein said peripheral edge of said elongated supporting member and said groove of said third gear define a cutting means path; and said cutting means comprising a plurality of links, each of said links being pivotally coupled to each other such that a loop of said links is defined.

2. The power cutting device of claim 1, wherein said handle member comprises a base having a first leg and a second leg being integrally coupled thereto and extending away from said base, each of said legs being integrally coupled to said second end of said housing, said base having an inner surface and an outer surface, said inner surface of said base having a notch therein, said notch being positioned generally adjacent to said first leg, wherein said first actuating means being positioned in said notch of said inner surface of said handle member.

3. The power cutting device of claim 1, further comprising:

a second actuating means for selectively varying the speed of said motor, said second actuating means extending outwardly through said handle member, said second actuating means being operationally coupled to said motor.

4. The power cutting device of claim 1, wherein said motor is positioned generally adjacent to said second end of said housing, said motor being securably coupled to said inner surface of said peripheral wall of said housing.

5. The power cutting device of claim 4, wherein said motor is an electric motor.

6. The power cutting device of claim 5, further comprising:

a power cord, said power cord being operationally coupled to said electric motor.

7. The power cutting device of claim 1, wherein each of said shafts is orientated generally perpendicular to a longitudinal axis of a line extending through said first and said second ends of said housing and parallel to a plane of said bottom side of said housing, said first shaft being positioned adjacent to said first end of said housing and generally nearer said top side of said housing than said bottom side of said housing, said second shaft being positioned generally adjacent to said first end of said housing and positioned generally nearer said bottom side of said housing than said top side of said housing, said third shaft being positioned generally adjacent to said first and second shafts, said fourth shaft being positioned generally adjacent to said third shaft.

8. The power cutting apparatus of claim 1, wherein said blade supporting member has an elongated hole and a pair of elongated slots therein, each of said slots being positioned generally adjacent to said second end of said blade supporting member, said first and second shafts of said housing each having a size and shape adapted for being removably positioned in one of said elongated slots, a pair of fastening means for securing said blade supporting member to said first and second shafts, each of said fastening means being securably coupled to a free end of said first and second shafts, said elongated hole being positioned generally between said pair of elongated slots and generally nearer said second end of said blade supporting member than each of said elongated slots, said third shaft of said housing having a size and shape adapted for extending into said elongated hole.

9. The power cutting apparatus of claim 1, wherein each of said links has a bottom portion and a top portion, each of said top portions comprising a blade member extending away from said bottom portion, each of said bottom portions comprising a block member, each of said block members being movably positionable in said cutting means path, a bottom surface of each of said bottom portions having a niche therein for selectively receiving one of said teeth in said third gear.

10. A power cutting device comprising:

a housing, said housing having, a first end, a second end and a peripheral wall extending there between, said peripheral wall having a top side, a bottom side, a first lateral side, a second lateral side, said first end having an opening therein, said peripheral wall having a plurality of apertures therein, each of said apertures being positioned in said first lateral side and positioned generally adjacent to said second end of said housing, said peripheral wall tapering to said first end;

a first shaft, a second shaft, a third shaft and a fourth shaft, each of said shafts having a first end and a second end, said first end of each of said shafts being securably coupled to an inner surface of said peripheral wall in said housing, each of said shafts being orientated generally perpendicular to a longitudinal axis of a line extending through said first and said second ends of said housing and parallel to a plane of said bottom side of said housing, said first shaft being positioned adjacent to said first end and generally nearer said top side of said housing than said bottom side of said housing, said second shaft being positioned generally adjacent to said first end of said housing and positioned generally nearer said bottom side of said housing than said top side of said housing, said third shaft being positioned generally adjacent to said first and second shafts, said fourth shaft being positioned generally adjacent to said third shaft;

a handle member, said handle member comprising a base having a first leg and a second leg being integrally coupled thereto and extending away from said base, each of said legs being integrally coupled to said second end of said housing, said base having an inner surface and an outer surface, said inner surface of said base having a notch therein, said notch being positioned generally adjacent to said first leg;

a motor, said motor being positioned generally in said housing and positioned generally adjacent to said second end of said housing, said motor being securably coupled to said peripheral wall of said housing, said motor comprising an electric motor;

a power supply for powering said motor, said power supply being operationally coupled to said motor, said power supply comprising a cord;

a first actuating means for starting said motor, said first actuating means being positioned in said notch of said inner surface of said handle member, said first actuating means being operationally coupled to said motor, said first actuating means comprising a switch;

a second actuating means for selectively varying the speed of said motor, said second actuating means extending outwardly through said handle member, said second actuating means being operationally coupled to said motor;

a plurality of gears, each of said gears having a peripheral edge having a plurality of teeth coupled thereto and extending away therefrom, said plurality of gears including;

a first gear, said first gear being mechanically coupled to said motor, wherein said motor is adapted to rotate said first gear;

a second gear, said fourth shaft extending through said second gear, said second gear being positioned such that said teeth of said second gear may engage said teeth of said first gear, wherein said first gear rotates said second gear;

a third gear, said third gear being securably coupled to said second end of said fourth shaft, said third gear having a peripheral edge having a groove therein, a plurality of teeth extending outwardly from said groove;

a blade supporting member for supporting a cutting means, said blade supporting member comprising an elongated member having a first end, a second end, a first side, a second side and a peripheral edge, said first end of said blade supporting member being generally rounded, said second end of said blade supporting member being positioned generally in said housing such that said blade supporting member extends through said opening in said first end of said housing, said blade supporting member having an elongated hole and a pair of elongated slots therein, each of said slots being positioned generally adjacent to said second end of said blade supporting member, said first and second shafts of said housing each having a size and shape adapted for being removably positioned in one of said elongated slots, a pair of fastening means for securing said blade supporting member to said first and said second shaft, each of said fastening means being securably coupled to a free end said first and second shafts, said elongated hole being positioned generally between said pair of elongated slots and generally nearer said second end of said blade supporting member than each of said elongated slots, said third shaft of said housing having a size and shape adapted for extending into said elongated hole, said peripheral edge of said blade supporting member having a groove therein, wherein said peripheral edge of said elongated supporting member and said groove of said third gear define a cutting means path; and a cutting means for cutting a variety of materials, said cutting means comprising a plurality of links, each of said links being pivotally coupled to each other such that a loop of said links is defined, each of said links having a bottom portion and a top portion, each of said top portions comprising a blade member extending away from said bottom portion, each of said bottom portions comprising a block member, each of said block members being movably positionable in said cutting means path, a bottom surface of each of said bottom portions having a niche therein for selectively receiving one of said teeth in said third gear;

wherein said motor rotates said first gear such that said second gear rotates said third gear wherein said cutting means is moved about said cutting means path.

11. A power cutting device comprising:

a housing having a first end and a second end;

a handle member being coupled to said second end of said housing;

a motor being positioned generally in said housing;

a first gear being mechanically coupled to said motor;

an elongated blade supporting member being positioned generally in said housing, said blade supporting member having a longitudinal axis, said blade supporting member having a pair of elongated lateral slots extending substantially parallel to said longitudinal axis, and an elongated hole extending substantially parallel to said longitudinal axis; and a cutting means for cutting a variety of materials, said cutting means being movably coupled to said blade supporting member and said first gear;

a first shaft and a second shaft being mounted on said housing and extending through said lateral slots in said elongated member;

securing means for adjustably securing a position of said first and second shafts in said lateral slots of said blade supporting member;

a third shaft mounted on said housing and extending through said elongated hole, said third shaft being freely slidable in said elongated hole.

12. The power cutting device of claim 11, wherein said third shaft has a substantially rectangular cross sectional shape, and sides of said third shaft slidingly contact sides of said elongated hole of said blade supporting member for resisting rotation of said blade supporting member about said third shaft.

* * * * *